US009322075B2

(12) United States Patent
Kim et al.

(10) Patent No.: US 9,322,075 B2
(45) Date of Patent: Apr. 26, 2016

(54) HIGH-STRENGTH AND HIGH-TOUGHNESS ULTRAFINE WIRE ROD

(75) Inventors: Dong-Hyun Kim, Pohang (KR); Woo-Gi Shin, Pohang (KR); You-Hwan Lee, Pohang (KR)

(73) Assignee: POSCO, Pohang-si (KR)

( * ) Notice: Subject to any disclaimer, the term of this patent is extended or adjusted under 35 U.S.C. 154(b) by 499 days.

(21) Appl. No.: 13/695,121

(22) PCT Filed: May 6, 2011

(86) PCT No.: PCT/KR2011/003396

§ 371 (c)(1),
(2), (4) Date: Oct. 29, 2012

(87) PCT Pub. No.: WO2011/139117

PCT Pub. Date: Nov. 10, 2011

(65) Prior Publication Data

US 2013/0048159 A1 Feb. 28, 2013

(30) Foreign Application Priority Data

May 6, 2010 (KR) ..... 10-2010-0042498

(51) Int. Cl.

| | |
|---|---|
| ***C22C 38/02*** | (2006.01) |
| ***C22C 38/04*** | (2006.01) |
| ***C21D 9/52*** | (2006.01) |
| ***C21D 8/06*** | (2006.01) |

(52) U.S. Cl.

CPC ..... *C21D 9/52* (2013.01); *C21D 8/065* (2013.01); *C22C 38/02* (2013.01); *C22C 38/04* (2013.01); *C21D 2211/003* (2013.01); *C21D 2211/005* (2013.01)

(58) Field of Classification Search

None

See application file for complete search history.

(56) References Cited

U.S. PATENT DOCUMENTS

| | | | | |
|---|---|---|---|---|
| 4,901,550 | A | 2/1990 | Koide et al. | |
| 2006/0057419 | A1 * | 3/2006 | Hayashi et al. ..... | 428/638 |

FOREIGN PATENT DOCUMENTS

| | | | |
|---|---|---|---|
| EP | 2034036 | A2 | 3/2009 |
| JP | 8004837 | B2 | 1/1996 |
| JP | 2009062574 | A | 3/2009 |
| JP | 2009132958 | A | 6/2009 |
| JP | 2009138251 | A | 6/2009 |
| JP | 2009144230 | A | 7/2009 |
| KR | 20100045729 | A | 5/2010 |
| WO | 2004108970 | A2 | 12/2004 |

OTHER PUBLICATIONS

Machine-English translation of Japanese application publication No. 2005-281838, Nakada Hiroshi et al., Oct. 13, 2005.*

Sun, S.H. et al., Microstructure characteristics in high carbon steel rod after warm cross-wedge rolling, Scripta Materialia, 2005, vol. 53, pp. 137-140.

* cited by examiner

*Primary Examiner* — Deborah Yee

(74) *Attorney, Agent, or Firm* — The Webb Law Firm

(57) ABSTRACT

Provided is an ultra-fine grained, high-strength, high-toughness carbon steel wire rod manufactured through control of a microstructure by process control without addition of relatively expensive alloying elements. More particularly, the material provided is an ultra-fine grained, high-strength, high-toughness carbon steel wire rod having a microstructure including a ferrite structure having an area fraction of 60% or more and a cementite structure as a remainder, wherein an average grain diameter of ferrite grains is 15 μm or less. Also provided is a method of manufacturing the wire rod.

4 Claims, 4 Drawing Sheets

HIGH-STRENGTH AND HIGH-TOUGHNESS ULTRAFINE WIRE ROD

TECHNICAL FIELD

The present invention relates to a high-strength, high-toughness wire rod, and more particularly, to a wire rod having excellent strength and toughness obtained by control of the microstructure thereof, and a method of manufacturing the same.

BACKGROUND ART

In line with the trend for high strengthening and weight reductions in the automotive industry, along with recent increases in the prices of ferro alloys, the use of rare metal resources as a geopolitical bargaining chip has continued. Accordingly, there is a need to develop an ultra-fine grained wire rod having high strength and high ductility, even without the addition of ferro alloys.

Typically, techniques of adding alloying elements, such as niobium (Nb), titanium (Ti), and vanadium (V), have been suggested in order to refine a microstructure. These techniques may be regarded as a method of obtaining fine ferrite phases by allowing the added alloying elements to form precipitates and the precipitates to prevent the growth of austenite grains.

Also, in addition to the method detailed above, a controlled rolling technique, in which rolling is performed at a temperature appropriate for minimizing grain size, has also been used, and, as a result, a diameter of ferrite grains has been able to be refined to about 20 μm.

In addition to the controlled rolling technique, since there have been continuous requirements for grain refinement, a Thermomechanical Control Process (TMCP), in which mechanical properties are improved through the refinement of a grain structure by control of a rolling speed and a cooling rate, has also been introduced.

However, all of the foregoing grain refinement techniques may be suitable for producing steel plates, but may be difficult to apply to the production of wire rods. That is, since a wire rod may have a very high cross-section reduction rate in comparison to that of a thick steel plate, a rolling speed may be relatively fast, control of a cooling rate may not be facilitated, and in particular, with respect to water cooling, surface defects may be generated by the formation of martensite grains on the surface thereof. Therefore, the TMCP having a key role in controlling the rolling speed and the cooling rate may not be suitable for wire rods and a manufacturing technique suitable for wire rods has also been required.

Patents related to a technique of manufacturing a fine grained, high-strength, high-toughness wire rod include Japanese Patent Application Laid-Open Publication Nos. 2009-62574, 2009-138251, and 2009-132958. These patents may be limited to a method of obtaining a segmented ferrite and cementite structure through fractures in cementite grains by performing high reduction rolling, in addition to the addition of alloying elements, a cooling rate change, and controlling of alloying elements and cooling rates.

In the case of the segmented ferrite and cementite structure, there may be an advantage in that segmented ferrite grains act as fine precipitate hardening materials to significantly increase the strength of a wire rod, but there may also be disadvantages, in that a decrease in ductility may inevitably be accompanied by an increase in strength according to the Hall-Petch equation.

Also, since rolling must be performed after the formation of cementite grains or the like in order to segment cementite grains or the like, there may be a need for widening a two-phase region in which cementite grains or the like may be formed, and, for this purpose, the addition of alloying elements may be essential. Therefore, an increase in costs may also be incurred.

Other techniques related to a fine grained wire rod include an ultra-fine grained wire rod manufactured by using a powder metallurgy method using fine powder. However, a wire rod manufactured in a powder metallurgy scheme may have a limitation in its use and may have a disadvantage in that its strength may be decreased due to a decrease in sinterability of fine particles thereof during sintering.

Meanwhile, other techniques related to manufacturing an ultra-fine grained wire rod by using a rolling or cooling method may be relatively restrictive in number and most thereof may only be a technique limiting a size of a pearlite structure through controlling finish rolling and lead patenting (LP) temperatures. In particular, in consideration of the fact that the pearlite structure itself has fine grains, these techniques may not have a special technical meaning.

Therefore, a technique for manufacturing an ultra-fine grained wire rod by using carbon steel may have high utility. However, since a satisfactory technique may not have been suggested to date, there may be an urgent need for developing a technique therefor.

SUMMARY OF THE INVENTION

An aspect of the present invention provides a wire rod securing high strength and high toughness through the promotion of grain refinement without the addition of alloying elements and a method of manufacturing thereof.

According to an aspect of the present invention, there is provided a carbon steel wire rod having a microstructure including: a ferrite structure having an area fraction of 60% or more; and a cementite structure as a remainder, wherein an average grain diameter of ferrite grains is 15 μm or less.

According to another aspect of the present invention, there is provided a method of manufacturing an ultra-fine grained, high-strength, high-toughness wire rod through heating a bloom or billet, wire-rod rolling, cooling, and winding including: cooling a wire rod subjected to the wire-rod rolling to a temperature ranging from 150° C. to 350° C.; and then rapid cooling the wire rod to a temperature of −100° C. or less.

According to the present invention, an ultra-fine grained, high-strength, high toughness wire rod able to secure tensile strength and elongation on the level of alloy steel may be provided by using carbon steel without an alloying element included therein. Since relatively expensive alloying components, such as titanium (Ti), niobium (Nb), vanadium (V), and chromium (Cr), may not be added thereto, cost competitiveness may be secured and a technique related to manufacturing of an ultra-fine grained wire rod, commercialized by using a powder metallurgy method, may be secured.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1A:
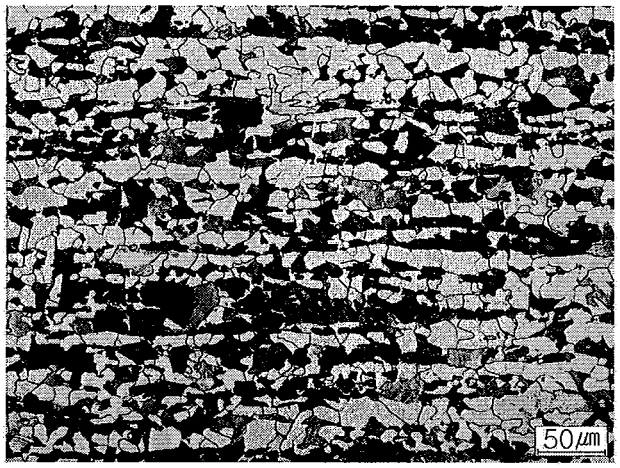
FIGS. 1(*a*) and 1(*b*) are micrographs respectively showing a microstructure of Comparative Example 1 and a microstructure of Inventive Example 1 of Steel 1 according to Example 1 of the present invention.

Hereinafter, the present invention will be described in greater detail.

The inventors of the present invention conducted a great deal of research into a method of manufacturing a high-strength, high-toughness carbon steel wire rod without using a ferro alloy containing relatively expensive alloying elements, such as titanium (Ti), niobium (Nb), and vanadium (V), added thereto.

According to the result of research, the inventors of the present invention developed a wire rod having a microstructure including: a ferrite structure having an area fraction of 60% or more; and a cementite structure as a remainder, wherein an average grain diameter of ferrite grains is 15 μm or less. Accordingly, the inventors of the present invention understood that high strength and high toughness of a wire rod may be achieved, and thus, completed the present invention.

The wire rod of the present invention includes ferrite grains having an area fraction of 60% or more and cementite grains as a remainder. In the case that the fraction of ferrite grains is less than 60%, ductility decreases due to a decrease in the fraction of ferrite grains and thus, a balance of strength and toughness is deteriorated due to an increase in strength according to the Hall-Petch equation. Therefore, the fraction of ferrite grains may be 60% or more.

Also, the wire rod of the present invention may have ferrite grains having an average grain diameter of 15 μm or less. In the case that a size of ferrite grains is reduced, a specific surface area of the grain increases. Therefore, strength thereof may increase, but ductility may not decrease by the smooth action of a slip system. Accordingly, the wire rod of the present invention may secure high tensile strength and simultaneously, may secure ductility having a high elongation.

In the case that the grain diameter of ferrite grains is not refined in the case that the average grain diameter of ferrite grains is greater than 15 μm, an effect of increasing strength may not only be insignificant, but toughness and ductility may also decrease due to a decrease in the fraction of ferrite grains per unit area and the effect of increasing strength due to the refinement of ferrite grains may also not be secured.

Also, the ferrite grains in the wire rod of the present invention may have a bainitic shape. Ferrite grains having such shape are denoted as "bainitic ferrite". Bainitic ferrite has an acicular shape and is formed of a structure in a lath phase. The bainitic ferrite does not include internal precipitates and is formed of parallel lath groups having a specific habit plane with respect to austenite, a matrix phase. Since all the lath groups have the same variant, a misorientation therebetween may be relatively low, and thus, a low angle grain boundary to be described later may be formed.

Therefore, the wire rod of the present invention may promote an increase in the fraction of ferrite grains in comparison to that of general ferrite grains due to the inclusion of bainitic ferrite grains and thus, may have an effect of simultaneously increasing toughness, ductility, and strength.

The microstructure of the wire rod of the present invention may have a crystal orientation measured by electron backscattered diffraction (EBSD) of 30 degrees or less. In the case that the crystal orientation is 30 degrees or less, it may be denoted as a low angle grain boundary. Since the wire rod of the present invention may have low angle grain boundaries, a fraction of fine ferrite grains may be increased, and thus, strength may not only be improved, but toughness and ductility may also be increased. Therefore, a structure able to improve mechanical properties may be formed.

For example, a composition of the wire rod of the present invention may include 0.15 wt % to 0.5 wt % of carbon (C), 0.1 wt % to 0.2 wt % of silicon (Si), and 0.1 wt % to 0.7 wt % of manganese (Mn). In addition to the above components, the composition may include iron (Fe) as well as other unavoidable impurities as a remainder. Other components may be added in addition to the foregoing components, but the addition of the other components does not affect the overall technical idea of the present invention.

The wire rod of the present invention may have a tensile strength of 1100 MPa or more and an elongation of 20% or more, and may have an ECO-index (tensile strength×elongation), representing the interrelationship of strength and ductility, of 2000 or more.

Hereinafter, a method of manufacturing a wire rod of the present invention will be described in detail. A microstructure of the wire rod may be controlled according to controlling a cooling rate after rolling of the wire rod during a manufacturing process thereof. Therefore, an embodiment of manufacturing the wire rod of the present invention through controlling the cooling rate will be described in detail.

Typically, a bloom or billet is heated and subjected to wire-rod rolling, and a wire rod is then manufactured through cooling and winding. As an example of the process for manufacturing a carbon steel wire rod, a carbon steel bloom or billet is reheated at a temperature of 1100° C. or more and subjected to wire-rod rolling at a temperature ranging from 900° C. to 1000° C., and the carbon steel wire rod is then manufactured through winding after cooling.

The method of manufacturing a wire rod of the present invention includes rapid cooling to a temperature ranging from −150° C. to −100° C. or less, after cooling the wire rod subjected to wire-rod rolling to a temperature ranging from 150° C. to 350° C. A process of cooling the wire rod subjected to wire-rod rolling to a temperature ranging from 150° C. to 350° C. may be performed by using an air cooling process.

Rapid cooling does not denote typical water cooling or air cooling, but denotes that the wire rod is rapidly cooled in the space of a few seconds. Typically, it is considered that a martensite structure is obtained when heated steel is quenched. However, the present invention deviates from this conventional idea.

In the present invention, the rapid cooling is performed and thus, diffusion may be inhibited during a cooling process to prevent grain growth, and a state immediately preceding the recrystallization of the microstructure, that is, a process of grain freezing that forms laths having a sheaf-like shape in the structure as in the structure of bainite may be undertaken after rolling due to the rapid cooling. As a result, a microstructure composed of ferrite grains having fine grains and cementite grains may be formed.

In other words, an ultra-fine grained structure may be formed by preventing the growth of ferrite grains through the rapid cooling, and transformation typically occurring in carbon steel may be inhibited and thus, a structure including 60% or more of ferrite grains and cementite grains as a remainder may be formed. In particular, the ferrite grains are formed as bainitic ferrite grains.

A cooling rate for the rapid cooling may be in a range of 100° C./sec to 150° C./sec. The rapid cooling does not denote typical water cooling, but aims at freezing grains through a coolant to be described later. Therefore, the cooling rate must be 100° C./sec or more and may be in a range of 100° C./sec to 150° C./sec.

Liquid nitrogen and dry ice may be used as the coolant used for the rapid cooling and a polymer solution for cooling a wire rod may be used. For example, the polymer solution may be formed of 15% to 30% of polyalkylene glycol (PAG) and 70% to 85% of water ($H_2O$). For example, the coolant may be liquid nitrogen.

In the rapid cooling, the wire rod is cooled to a temperature within a range of −100° C. or less and may be cooled to a temperature within a range of −100° C. to −150° C. In the case that the temperature is less than −150° C., a surface of the wire rod is rapidly cooled and thus, surface defects on the wire rod itself may be generated. In the case in which the temperature is greater than −100° C., a sufficient cooling effect may not be obtained and thus, control of the structure of the wire rod required in the present invention may be impossible.

The rapid cooling may be performed by dipping the wire rod into the coolant, and at this time, a dipping time may be in a range of 1 minute to 10 minutes. In the case that the dipping time is less than 1 minute, cooling of the wire rod may be insufficient and thus, the structure required in the present invention may not be formed. In the case in which the dipping time is greater than 10 minutes, to be relatively long, the process time for manufacturing the wire rod may become relatively long and thus, productivity may decrease.

MODE FOR INVENTION

Hereinafter, the present invention will be described in detail, according to specific examples. However, the following examples are merely provided to allow for a clearer understanding of the present invention, rather than to limit the scope thereof.

Example 1

S45C steel (hereinafter, referred to as "Steel 1") and 45F steel (hereinafter, referred to as "Steel 2") were prepared in accordance with American Society for Testing Materials (ASTM), and wire-rod rolling for manufacturing a wire rod was then performed thereon. Thereafter, a portion thereof was cut and cooled to a temperature of 300° C., and rapid cooling was then performed by dipping the portion in liquid nitrogen at −150° C. for 5 minutes. In order to simulate winding, samples were recovered at room temperature. Hereinafter, the samples subjected to the operation of the present invention were respectively categorized as Inventive Example 1 of Steel 1 and Inventive Example 2 of Steel 2. In contrast, the samples not subjected to the rapid cooling were categorized as Comparative Example 1 of Steel 1 and Comparative Example 2 of Steel 2.

Figure 1B:
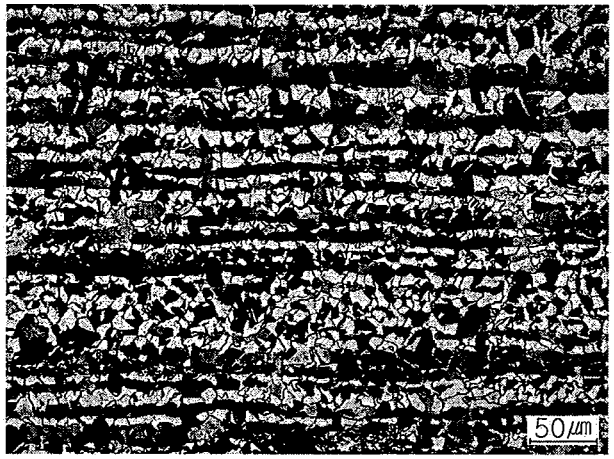
Figure 2:
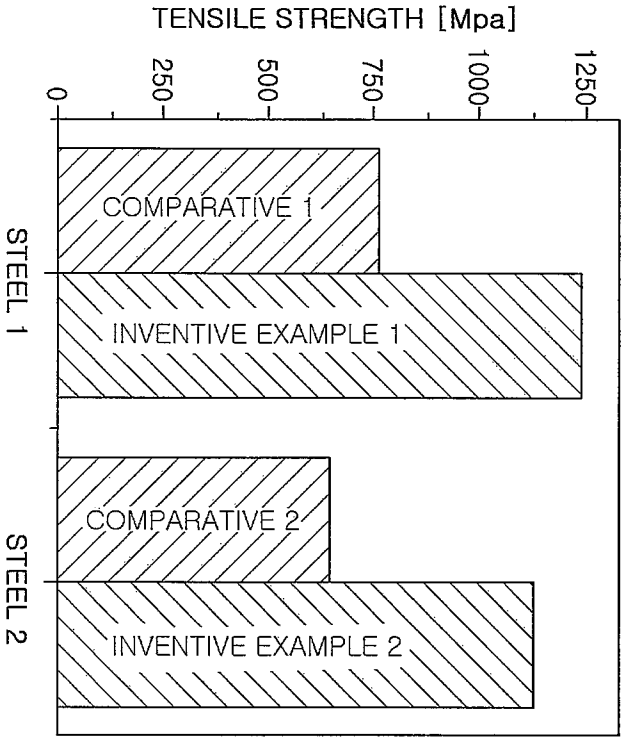
FIG. 2 is a graph showing the results of tensile strength measurements for Comparative Examples and Inventive Examples of Steels 1 and 2 according to Example 1 of the present invention.
Figure 3A:
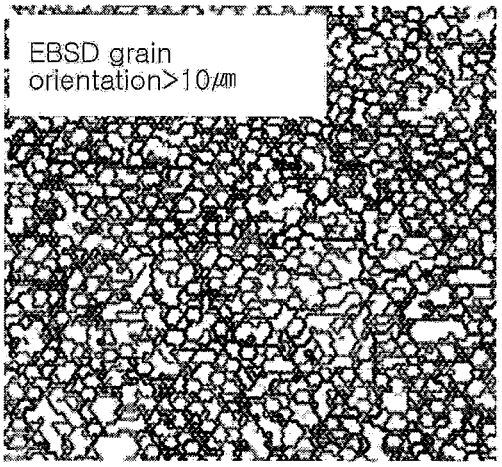
FIGS. 3(*a*) and 3(*b*) are an electron backscattered diffraction (EBSD) image and a micrograph of Inventive Example 2 of Steel 2 according to Example 1 of the present invention, respectively.
Figure 3B:
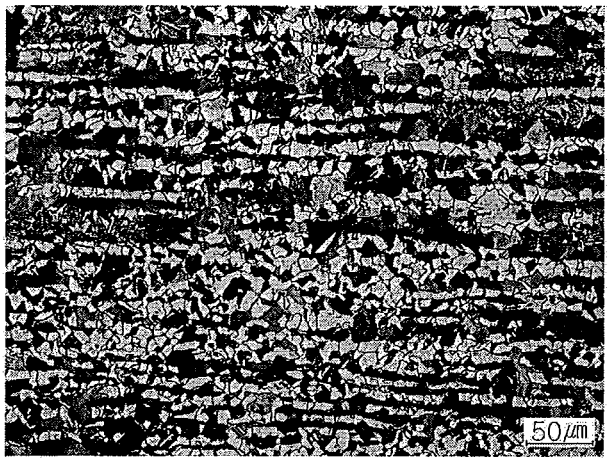

A microstructure of each sample was observed by using an optical microscope and an electron backscattered diffraction (EBSD) image thereof was observed, and the results thereof are presented in FIGS. 1 and 3, respectively. Tensile strength was measured for each sample and the results thereof are presented in FIG. 2.

FIGS. 1(*a*) and 1(*b*) are micrographs respectively showing a microstructure of Comparative Example 1 and a microstructure of Inventive Example 1 of Steel 1. As shown in FIG. 1(*a*), the sample of Comparative Example 1 was composed of two phases including ferrite grains having a grain diameter ranging from about 35 μm to about 40 μm and cementite grains. However, with respect to Inventive Example 1 shown in FIG. 1(*b*), it may be confirmed that the sample was composed of ultra-fine ferrite grains shaped like bainite (bainitic ferrite grains) having a grain diameter of about 12 μm and cementite grains.

FIG. 2 is a graph showing the results of tensile strength measurements for Comparative Examples and Inventive Examples of Steels 1 and 2. As shown in FIG. 2, it may be confirmed in Steels 1 and 2 that tensile strengths of the Inventive Examples were increased to about 1.5 times to about 2.0 times in comparison to those of Comparative Examples. The reason for this is that grain growth may be inhibited due to the rapid cooling in Inventive Examples to thus decrease a grain size of ferrite grains.

FIGS. 3(*a*) and 3(*b*) are an EBSD image and a micrograph of Inventive Example 2 of Steel 2, respectively. As shown in FIG. 3(*a*), it may be confirmed that low angle grain boundaries having a crystal orientation of 30 degrees or less were formed in the sample of Inventive Example 2, and, as shown in FIG. 3(*b*), it may be confirmed that the grain size of ferrite grains was about 12 μm or less.

Example 2

Meanwhile, the following Example was performed in order to identify mechanical properties in the case that drawing was performed by using a wire rod of the present invention. Samples were prepared by dry drawing Comparative Example 2 of Steel 2 at a ratio of 80% and the drawn samples were respectively annealed at 500° C. and 600° C. to prepare annealed samples. Drawn wire rods were prepared by dry drawing Inventive Example 2 of Steel 2 at a ratio of 80%. Mechanical properties thereof were measured and the results thereof are presented in FIG. 4.

Figure 4A:
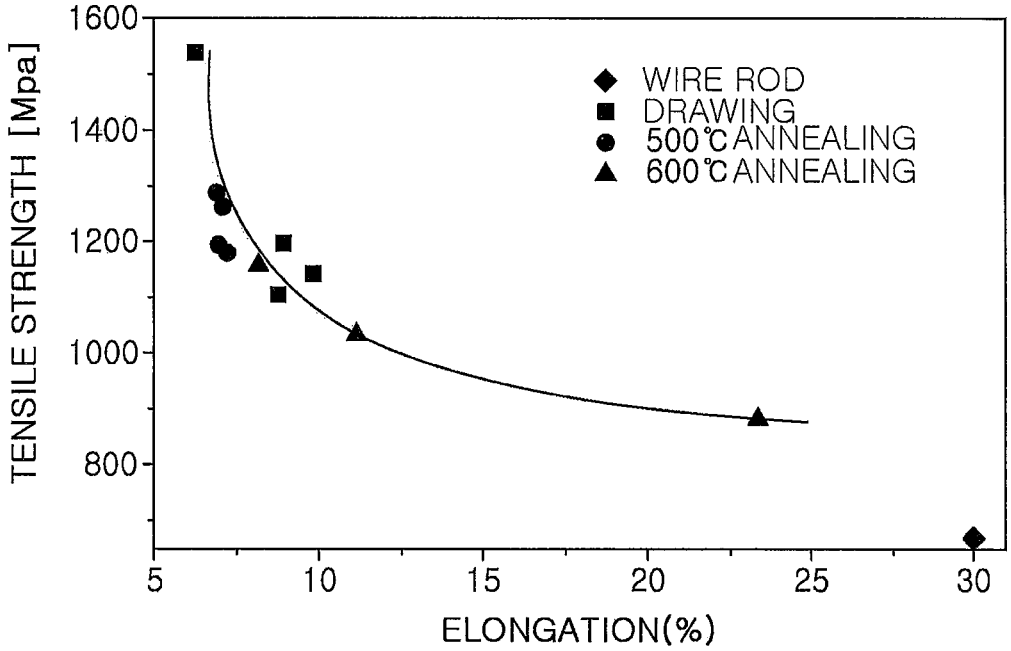
FIGS. 4(*a*) and 4(*b*) are graphs respectively showing mechanical properties after drawing and annealing wire rods of Comparative Example 2 and Inventive Example 2 of Steel 2 according to Example 2 of the present invention.
Figure 4B:
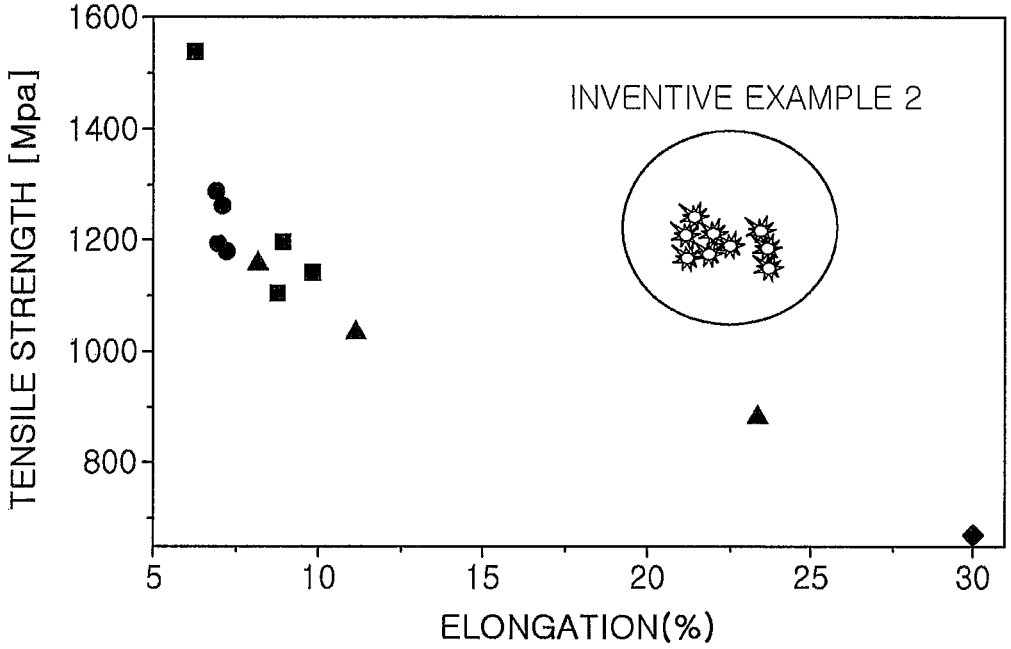

FIG. 4(*a*) is a graph showing mechanical properties of the dry drawn samples prepared using Comparative Example 2 and the annealed samples, and 4(*b*) is a graph simultaneously showing mechanical properties of the drawn wire rods prepared using Inventive Example 2.

As shown in FIG. 4(*a*), with respect to the drawn wire rods of Comparative Example 2 dry drawn at a ratio of 80%, it may be confirmed that tensile strength was increased to about 1600 MPa, but an elongation was less than about 10% according to a typical Hall-Petch effect. It may also be confirmed that ductility was not increased after annealing performed to anneal concentrated dislocations.

The reason for this is that dislocations may multiply due to a pile-up of dislocations during dry drawing, a grain size may be decreased by heavy deformation, and simultaneously, ductility may be decreased due to an increase in dislocation density.

However, as shown in FIG. 4(*b*), with respect to Inventive Example 2, it may be confirmed that elongation was about 23% on the average, in spite of the fact that tensile strength was about 1150 MPa or more. The reason for this is that a slip system may smoothly act to thus increase ductility, because both a fraction of ferrite grains per unit area and specific surface area of ferrite grains may increase. Meanwhile, with respect to Inventive Example 2 showing characteristics of ultra-fine grains, an ECO-index (tensile strength×ductility) was 2200 or more. However, with respect to Comparative Example 2, it may be confirmed that the ECO-index was not greater than a maximum of 1500.

While the present invention has been shown and described in connection with the exemplary embodiments, it will be apparent to those skilled in the art that modifications and variations can be made without departing from the spirit and scope of the invention as defined by the appended claims.

The invention claimed is:

1. An ultra-fine grained, high-strength, high-toughness wire rod having a microstructure comprising:

a ferrite structure having an area fraction of 60% or more; and a cementite structure as a remainder, wherein an average grain diameter of ferrite grains is 15 μm or less and the ferrite grains have a shape of bainitic ferrite, wherein the wire rod comprises 0.15 wt % to 0.5 wt % of carbon (C), 0.1 wt % to 0.2 wt % of silicon (Si), 0.1 wt % to 0.7 wt % of manganese (Mn), and iron (Fe) as well as other unavoidable impurities as a remainder.

2. The ultra-fine grained, high-strength, high-toughness wire rod of claim 1, wherein the ferrite has a crystal orientation measured by electron backscattered diffraction (EBSD) of 30 degrees or less.

3. The ultra-fine grained, high-strength, high-toughness wire rod of claim 1, wherein the wire rod has a tensile strength of 1100 MPa or more and an elongation of 20% or more.

4. The ultra-fine grained, high-strength, high-toughness wire rod of claim 1, wherein the wire rod has an ECO-index (tensile strength×ductility) of 2000 or more.

* * * * *